United States Patent [19]

Schriever

[11] 4,275,666

[45] Jun. 30, 1981

[54] MODULAR TABORET KIT

[75] Inventor: Theodore W. Schriever, Syracuse, N.Y.

[73] Assignee: Dart Industries Inc., Los Angeles, Calif.

[21] Appl. No.: 938,287

[22] Filed: Aug. 30, 1978

Related U.S. Application Data

[63] Continuation of Ser. No. 821,846, Aug. 4, 1977, abandoned.

[51] Int. Cl.[3] ..... A47B 57/00

[52] U.S. Cl. ..... 108/101; 108/111

[58] Field of Search ..... 180/101, 111, 64, 94, 180/92, 103

[56] References Cited

U.S. PATENT DOCUMENTS

| | | | |
|---|---|---|---|
| 3,170,415 | 2/1965 | Svilokos | 108/53.5 X |
| 3,831,533 | 8/1974 | Kellogg | 108/64 |

FOREIGN PATENT DOCUMENTS

| | | | |
|---|---|---|---|
| 531714 | 9/1954 | Belgium | 108/101 |
| 629629 | 3/1963 | Belgium | 108/111 |
| 1429725 | 11/1968 | Fed. Rep. of Germany | 108/111 |

*Primary Examiner*—Francis K. Zugel

*Attorney, Agent, or Firm*—Kenneth J. Hovet

[57] ABSTRACT

A substantially horizontal platform has at least three angularly spaced connection members carried proximate the periphery thereof. Each connection member is detachably engageable with a depending leg. Each connection member is also detachably engageable with a finial cap or, alternately, with an upstanding leg for supporting a second platform. Additional elements, including platforms and legs of various lengths, are likewise detachably engageable for the erection of various structural arrangements.

8 Claims, 12 Drawing Figures

MODULAR TABORET KIT

This is a continuation of application Ser. No. 821,846, filed 8/4/77 now abandoned.

BACKGROUND OF THE INVENTION

1. Field of the Invention

This invention relates to furniture.

More particularly, the present invention relates to the general class of decorator and accessory furnishings that includes tables, stands and similar items.

In a further aspect, the instant invention concerns a modular kit for the erection of a table or stand in accordance with optional alternate configurations.

2. Description of the Prior Art

Relatively small tables, stands and similar accessory furnishings, which can be generally referred to as taborets, are commonplace in domestic and commercial settings. As is well established, a variety of needs are serviced by taborets. Small tables, as accessory items for example, are usually placed near seating devices, such as tables and chairs, to provide a resting place for ashtrays, drinking vessels and frequently used personal items. Various tables and stands are also commonly used to support radios, lamps and ornamental decorator items. Floral displays and potted plants are often exhibited upon stands.

In an attempt to accommodate the unique needs and desires of differing individual preferences, the prior art has produced taborets in many configurations, designs and sizes. Stands and tables vary in height in accordance with a predetermined use. End tables are relatively low to accommodate a person in the seated position, while display stands are usually somewhat taller. Frequently a table will be provided with an auxiliary platform or shelf spaced below the main top or platform. It is not uncommon for display stands to include serveral platforms which are angularly disposed and at varying heights.

While adequately satisfying certain requirements, prior art taborets have inherent limitations. The commercially available selection is finite and may not comply with the exact desires of the potential customer. From the available offerings, the purchaser selects a taboret which is designed to fulfill a specific predetermined need. The item generally cannot be altered in form or size to serve an alternate function by a future change of heart attributed to redecoration or changing needs.

It would be highly advantageous therefore to resolve the foregoing problem of long standing associated with the prior art.

OBJECTS OF THE INVENTION

Accordingly, it is an object of the present invention to provide an improved taboret useful either as a table or as a stand.

Another object of the invention is the provision of a taboret in modular kit form.

And, another object of the invention is to provide a modular taboret kit which is readily erected without need for tools or special skills.

Still another object of the present invention is the provision of a modular taboret kit which can be erected into a stand or table to fulfill a variety of preselected needs.

Yet another object of the invention is to provide a kit from which a taboret can be assembled in accordance with predetermined criteria of height, number of platforms, general configuration and other options.

A further object of the invention is the provisions of a stand or table which can be readily disassembled for compact storage or subsequent preassembly in an altered form.

And, a further object of the instant invention is to provide a modular taboret kit of the above type having extended utility and which is durably constructed.

SUMMARY OF INVENTION

Briefly, to achieve the desired objects of the instant invention in accordance with a preferred embodiment thereof, first provided is a platform which assumes a horizontal position in the completed taboret. At least three angularly spaced connecting members are secured to the platform proximate the periphery thereof. The platform is supported in an elevated horizontal position by a first set of legs, each of which is detachably engageable at one end to one of the connecting members to depend therefrom.

In a further embodiment, a foot is detachably securable to the lower end of each leg. Also provided is a second set of legs. Each leg of the second set is detachably securable at the lower end thereof to the connecting member of the platform. A second platform, generally similar to the first platform, is connected to the second set of legs and supported at an elevation supported above the first platform.

In accordance with an alternate embodiment, there is provided a third platform similar to the first and second platforms. The third platform is supported at one connecting member by an especially adapted leg of the second set. Two additional legs detachably engaged with the remaining connecting members of the third platform extend to the floor and may include feet as previously noted. Upstanding finial caps are securable to the upper side of each exposed connecting members.

DESCRIPTION OF PREFERRED EMBODIMENTS

Figure 1:
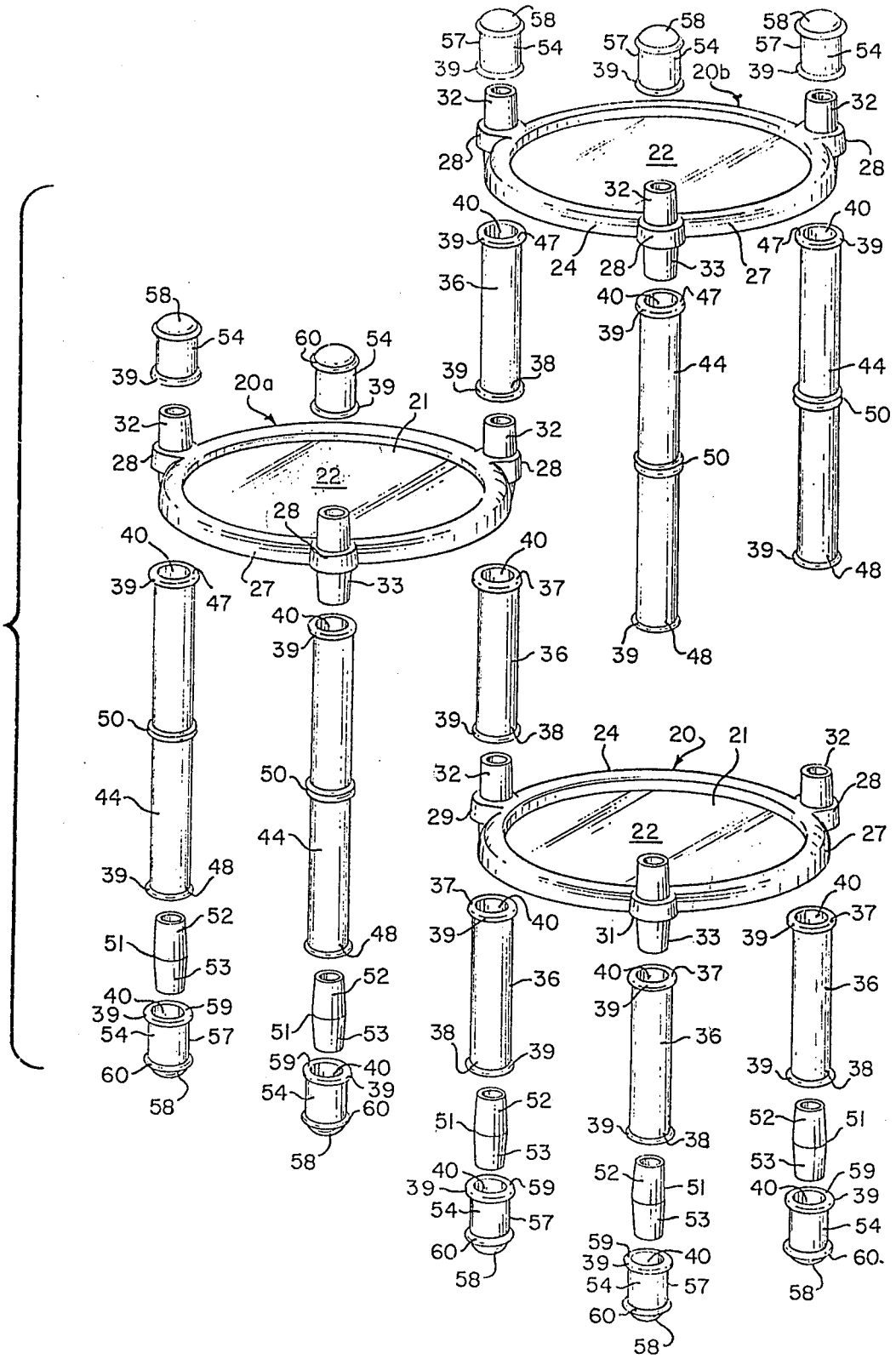
FIG. 1 is an exploded perspective view of a modular taboret kit cnstructed in accordance with the teachings of the present invention.

Turning now to the drawings in which the same reference numerals indicate corresponding elements throughout the several views, attention is first directed to FIG. 1 which shows the components of a modular taboret kit of the instant invention in a preselected arrangement chosen for purposes of illustration and reference for the ensuing discussion. It will be appreciated that the components are readily rearrangeable for the erection of a table or stand of alternate configuration, as will be described presently.

Figure 2:
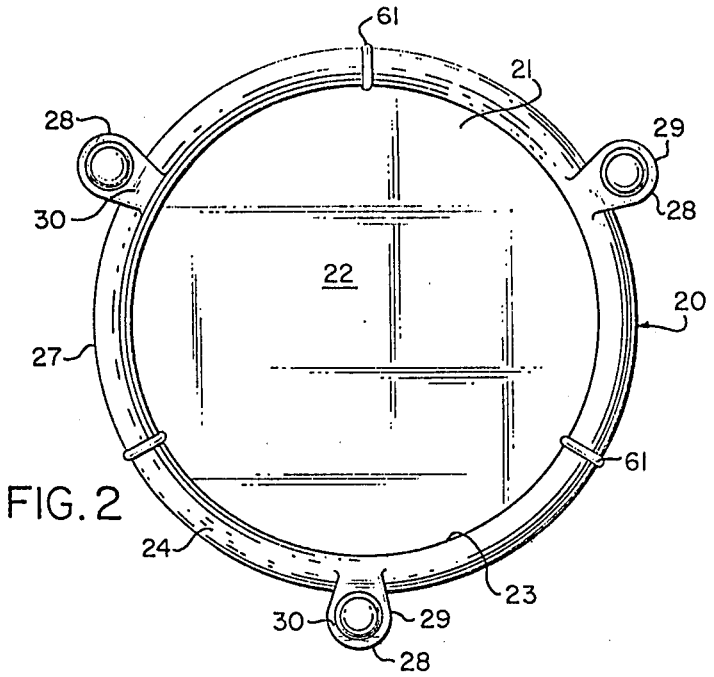
FIG. 2 is a plan view of a platform as used in connection with the device of FIG. 1.
Figure 3:
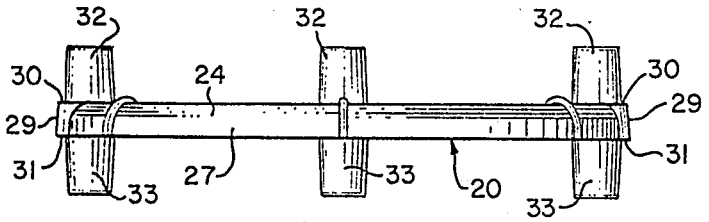
FIG. 3 is an elevation view of the platform of FIG. 2.
Figure 7:
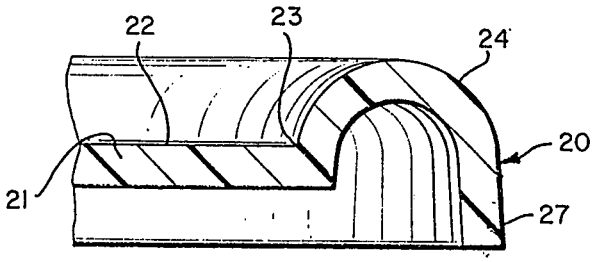
FIG. 7 is a vertical sectional view taken along the line 7—7 of FIG. 5.

In accordance with the immediate embodiment, there is provided a platform generally designated by the reference character 20 which is further seen in FIGS. 2 and 3. In accordance with design preference, platform 20 is generally circular and includes a substantially flat panel 21 having load bearing top surface 22 and periphery 23. Reinforcing bead 24, illustrated in greater detail in FIG. 7, circumscribes platform 20 and is integrally formed with periphery 23. Bead 24 is generally semicircular in cross section extending first upwardly from surface 22, then curving outwardly and downwardly terminating with a final section 27 forming the outer periphery of platform 20. In addition to adding strength and rigidity to the platform, bead 24 co-functions as a retainer for articles of liquids which may otherwise be displaced from surface 22.

Equiangularly spaced connecting members 28 are carried by platform 20 and extend beyond outer periphery 27. Each connecting member 28 includes a central section 29 which extends from bead 24 and is rounded at the free end. Surfaces 30 and 31 are located on the top and bottom respectively of central section 29. A first male member 32 extends upwardly from top surface 30 and a second male member 33 depends from bottom surface 31. Each male member 32 and 33 is generally cylindrical and functions as a connecting pin for detachable engagement with the various leg structures, as will now be described.

For purposes of discussion, legs 36, being the shortest of the several illustrated legs, comprise the first set of legs. The legs 36 are identical, each leg preferably being a hollow tubular structure and having a first end 37 and a second end 38. A bead 39, in the general shape of a torus, is integrally formed with and reinforces the hollow structure at each end 37 and 38.

Figure 6:
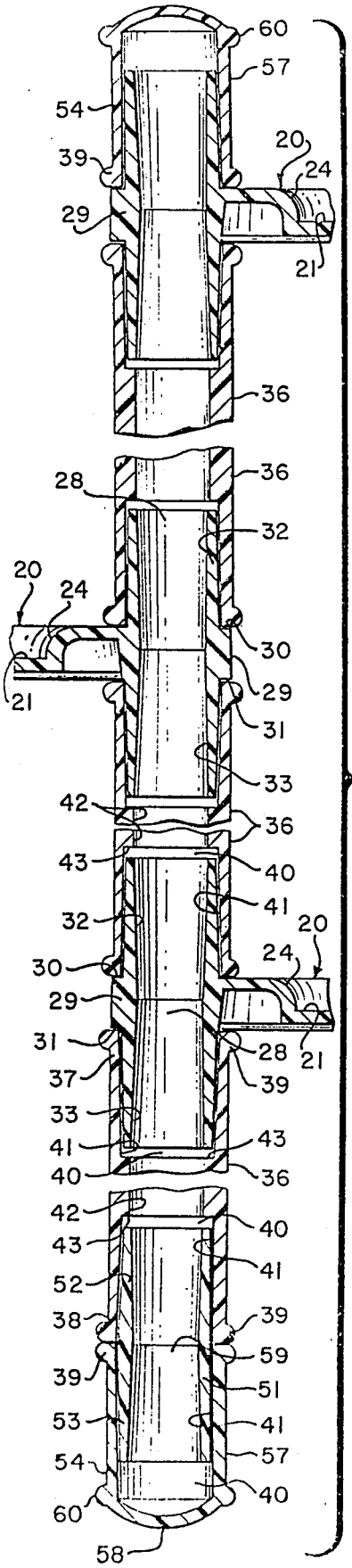
FIG. 6 is a vertical sectional view taken along the line 6—6 of FIG. 5 and further illustrating the engagement between the detachably connected elements thereof.

A socket 40, also viewed in FIG. 6, extends inwardly from end 37 of each leg 36. Each socket 40 has a generally cylindrical inner wall, which is larger in diameter than the nominal inner wall 42 of hollow tubular leg 36. Annular shoulder 43 extends radially between inner wall 41 and inner wall 42. A second socket 40 extends inwardly from second end 38, whereby the first end and second end, 37 and 38 respectively, are structurally interchangeable.

Each socket 40 is sized to receive second male member 33. In accordance with the immediately preferred embodiment, the depth of socket 40 exceeds the length of the second male member 33. During assembly, male member 33 is entered into socket 40 and bottom surface 31 of central section 29 rests upon bead 39 at end 37 of leg 36. For structural reasons, especially rigidity of the assembled device, it is desired that the elements be sized such that the outside surface of the male member 33 is closely received within inner wall 41 of socket 40.

As specifically illustrated in FIG. 6, the external surface of male member 33 and the inner wall 41 of socket 40 are mating and slightly conical to provide mechanical and friction engagement. Alternately, the mating components could have parallel sides and similarly, the lower end of male member 33 could bear against shoulder 43. It will be appreciated that regardless of the particular mode of connection, it is consistent with the teachings of the instant invention, that legs 36 are engageable and disengageable with platform 20 in response to manual manipulation.

Legs 44, being of a length greater than first legs 36, comprise the second set of legs. Legs 44 are of a uniform length and each includes a first end 47 and a second end 48. In common with legs 36, each leg 44 has a bead 39 at each end 47 and 48. Similarly, each leg 44 is a hollow tubular structure having an inner wall 49 and sockets 40 with inner wall 41 and annular shoulder 43 extending inwardly from first end 47 and second end 48. As previously noted, first male member 32 is identical to second male member 33. Socket 40 at lower end 48 of each leg 44 receives first male member 32 as previously described in connection with second male member 33 except that bead 39 at lower end 38 rests upon top surface 30 of central section 29. Leg 44 is reinforced intermediate the ends thereof by external annular bead 50 which for purposes of styling appears as two juxtaposed beads 39.

Each second leg 44 has a length equal to the combined length of two legs 36 and the thickness of central section 29. The thickness of central section 29 is defined as the distance between top surface 30 and bottom surface 31. Accordingly, one connecting member 28 of the platform designated 20*a* can be used in combination with two legs 36 to provide a height the same as the two legs 44 for horizontal support of the platform designated 20*b*. Similarly, two legs 44 can be detachably secured to the remaining connecting members 28 of platform 20*a* for proper horizontal support thereof.

Union members 51 comprise opposed first and second male members 52 and 53 respectively. Each male member 52 and 53 is sized and shaped similarly to previously described male members 32 and 33. First male members 52 are received in respective sockets 40 at the lower end 48 of each leg 44, and at the lower end 38 of each leg 36. It will be appreciated that either male member 52 or 53 is interchangeably engageable within socket 40 at the lower end of the respective leg.

Caps 54, each having an outer cylindrical wall 57 of substantially the same diameter of legs 36 and 44 and a closed rounded lower end 58, rests upon the supporting surface, such as a floor, and provide the neathermost support for the taboret of the instant invention. Each cap 54 has a socket 40 extending inwardly from open end 59. Open end 59 is reinforced by bead 39 as previously described. A second bead 60, generally similar in configuration to bead 39, encircles outer wall 57 proximate lower end 58.

Caps 54 function as feet when socket 40 of cap 54 is engaged with second male member 53 of union member 51. Caps 54 also function as finials when engaged with first male member 32 upstanding from each platform 20. Bead 39 of each cap 54 used as a finial bears against top surface 30 of central section 29. Bead 39 at the lower end of each respective leg bears against bead 39 of each cap 54 when cap 54 is used as a foot.

Figure 4:
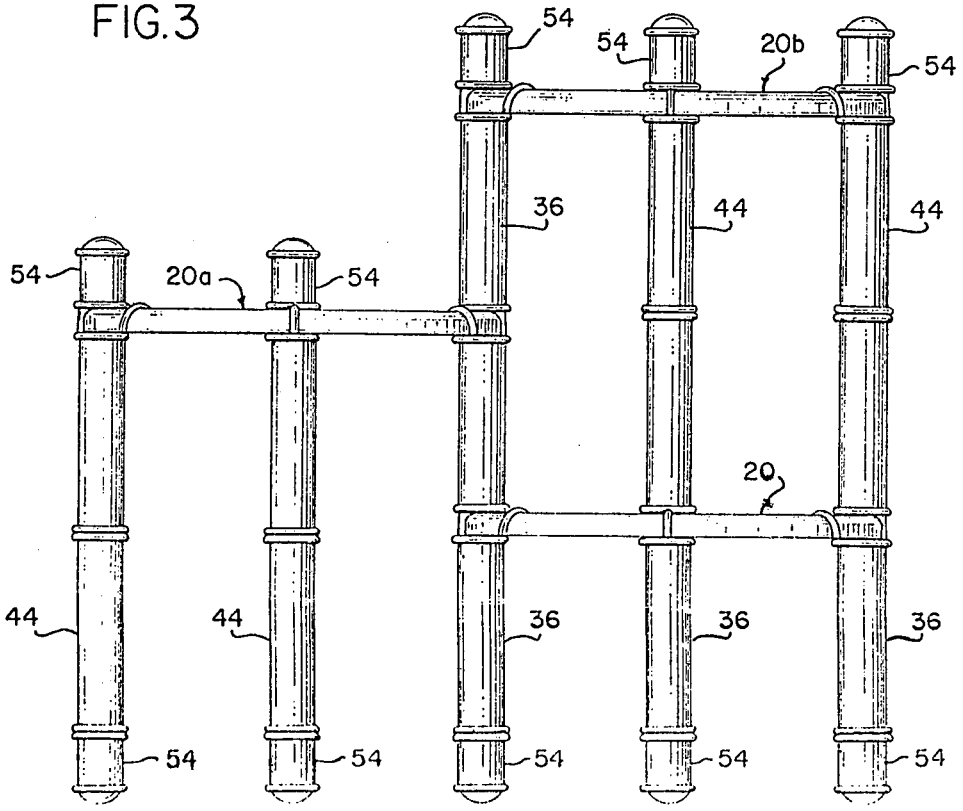
FIG. 4 is an elevation view of the assembled components as shown in FIG. 1.
Figure 5:
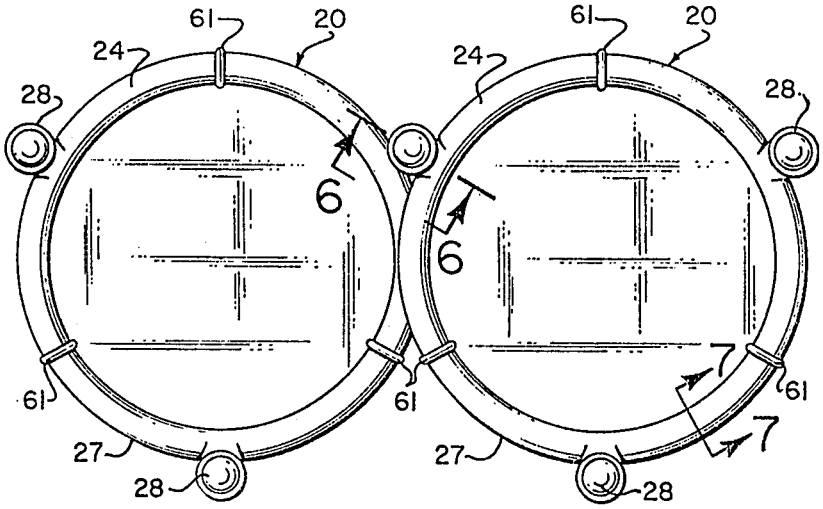
FIG. 5 is a plan view of the assembled taboret of FIG. 4.

FIGS. 4 and 5 illustrate the assembled table or stand, the individual components of which have been previously discussed and illustrated, especially in FIG. 1. It is particularly noted that, due to the inner-relation between the lengths of the several legs and the thickness of the central section 29 of connecting member 28, each platform 20 is supported in a substantially horizontal position. The platform designated **20*b* is spaced directly above platform 20. The platform designated 20*c* is elevated at a position intermediate platforms 20 and 20*b*. Due to the pivotal nature of the relationship between male members 32 and 33 and the respective sockets 40, the horizontal positioning of platform 20*c* relative platforms 20 and 20*b* is adjustably optional. It is also noted that reinforcing bead 24 of each platform 20 is provided rigidity by a radial bead 61 intermediate each connecting member 28**.

Figure 8:
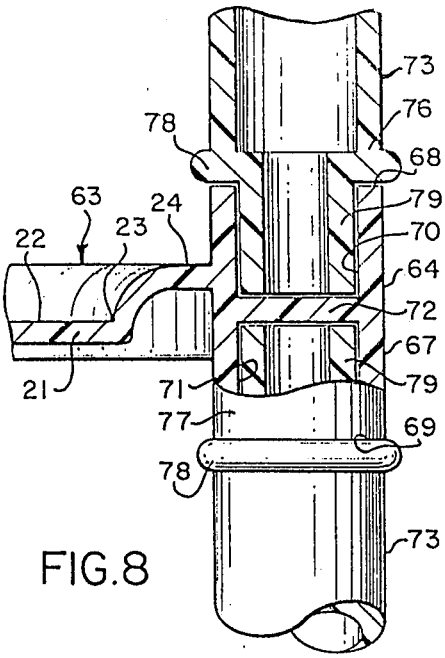
FIG. 8 is a vertical sectional view corresponding to a portion of FIG. 6 and showing an alternate preferred detachable connection means.

FIG. 8 illustrates an alternately preferred means of assembling the components of the modular table or stand of the instant invention. Alternate latform 63, generally similar to previously described platform 20, shares in common panel 21 with load bearing top surface 22 and periphery 23. Reinforcing bead 24 extends around panel 21 and terminates with outer periphery 27. Alternate connecting members 64 project beyond the outer periphery of platform 63 and are equiangularly spaced, being three in number as previously described in connection with connecting members 28.

Each connecting member 64 has an outer cylindrical surface 67 and first and second ends 68 and 69 respectively. First socket 70 extends inwardly from first end 68 and similarly second socket 71 extends inwardly from second end 69. Sockets 70 and 71 are separated by partition 72 intermediate ends 68 and 69. Hollow tubular legs 73, generally similar to previously described legs 36 and 44, terminate at first and second ends 76 and 77 respectively with reinforcing bead 78. Bead 78 is generally in the shape of a torus and corresponds to previously described bead 39. Male members 79 project from ends 76 and 77 beyond beads 78. Male members 79 are sized to be closely but detachably received within sockets 70 and 71. Alternate finial caps, not herein specifically illustrated, may also include sockets 74 in connection with male members 79.

Figure 9:
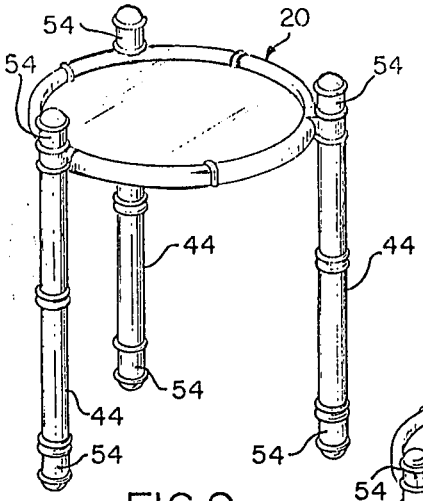
FIG. 9 is a perspective view of one configuration of taboret which can be erected from the modular kit of the instant invention.
Figure 10:
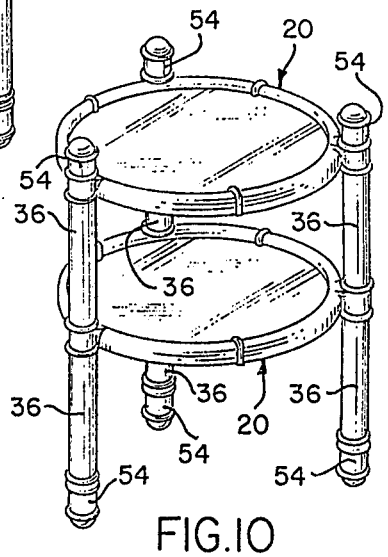
FIG. 10 is a perspective view of another taboret which can be constructed with the kit of the instant invention.
Figure 11:
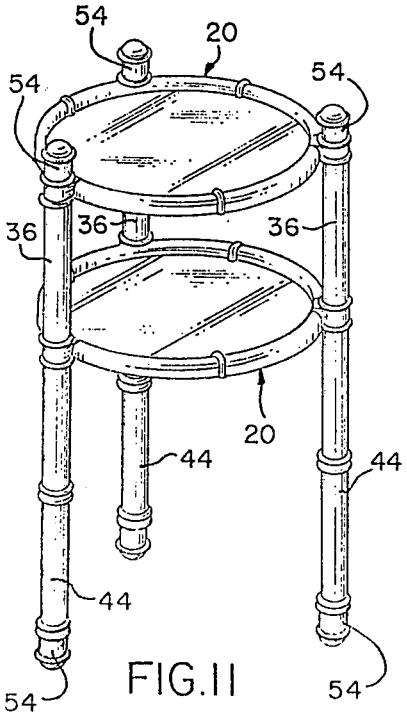
FIG. 11 is a perspective view of yet another taboret which is readily assembled using the kit of the instant invention.

FIG. 9 illustrates an alternate arrangement of the components of the modular taboret as hereinbefore described. The relatively low stand or table as illustrated includes one platform 20, four second legs 44, three union members 51 and six caps 54. A table of the same general height but having two platforms 20 is shown in FIG. 10. The lower platform 20 is supported by the use of six first legs 36 instead of three second legs 44. Replacing each lower first leg 36 with a second leg 44 provided a configuration set forth in FIG. 11.

Figure 12:
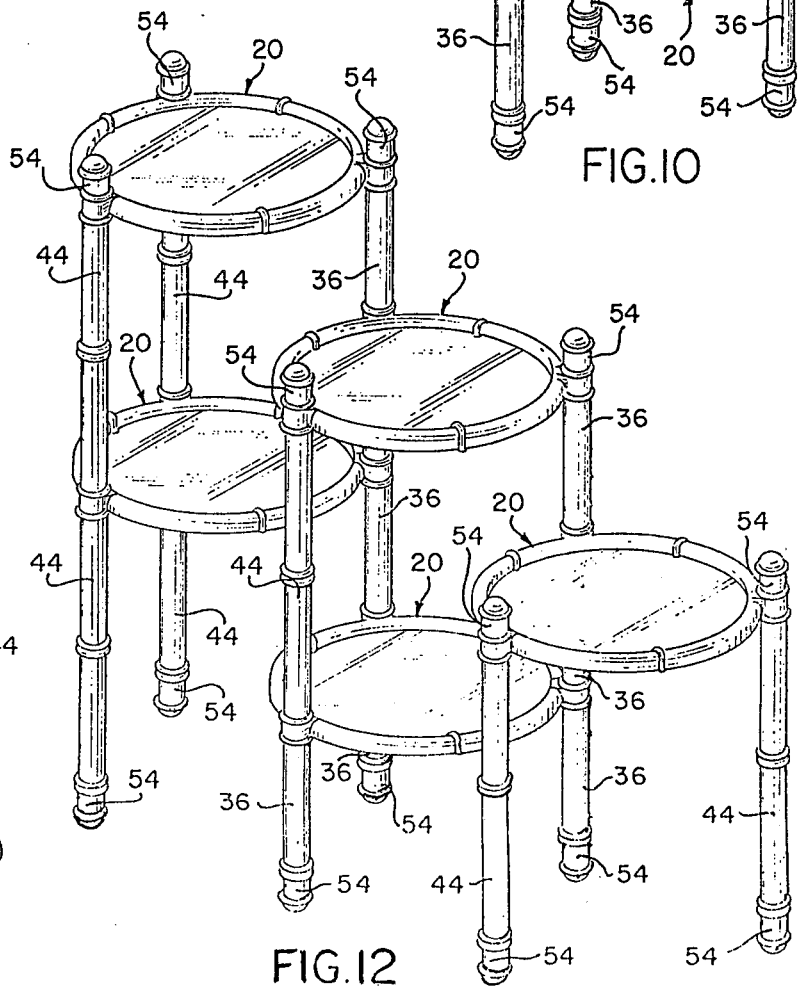
FIG. 12 is a perspective view of still a further arrangement of a taboret using the elements of the kit of the instant invention.

The variations of stands or tables which can be erected from a modular taboret kit of the instant invention is directly proportional to the number and type of components included therein. FIG. 12 illustrates a stand especially useful for the display of potted plants or decorator ornaments, having five load bearing surfaces provided by five platforms 20. The stand is readily assembled in accordance with the teachings of the instant invention from a kit containing the aforementioned five platforms and eight first legs 36, seven second legs 44, seven union members 51 and fourteen caps 54. Seven of the caps 54 are used as finials, while the other seven are used as feet.

Various changes and modifications to the embodiments herein chosen for purposes of illustration will readily occur to those skilled in the art. For example, each detachable connection can be affected by male-female assemblies such as a connecting pin received in a female socket in each component. Similarly, the material for construction is optional with the manufacturer. While it is preferred that the components of the kit be molded of a tough, durable, high impact, thermoplastic material, other materials, including metals such as aluminum can be formed into the shapes described.

Deviations of the shapes of the components from those chosen for purposes of illustration will also occur to those skilled in the art. To the extent that such modifications and variations do not depart from the spirit of the invention, they are intended to be included within the scope thereof.

Having fully described and disclosed the instant invention and the preferred embodiments thereof in such clear and concise terms as to enable those skilled in the art to understand and practice the same, the invention claimed is:

1. A taboret comprising:

first, second and third horizontal platforms vertically displaced from each other and horizontally offset from each other;

said first platform supported by a first set of three legs joined to the periphery thereof wherein each of said legs include at least three equilength connecting detachable leg members;

said second platform supported at the periphery thereof by one of said first set of legs by interconnection with the leg members thereof, and a second set of two legs joined to the periphery thereof each of which include at least two equilength interconnecting detachable leg members; and said third platform supported at the periphery thereof by one of said second set of legs by interconnection with said leg members, and a third set of two legs joined to the periphery thereof each of which include at least two equilength interconnecting detachable leg members wherein said platforms are round and include raised annular rim portions substantially semicircular in cross-section.

2. The taboret of claim 1 including a horizontal fourth platform located below said first platform and supported by interconnection to the leg members of at least one leg of said first set of three legs.

3. The taboret of claim 2 wherein said fourth platform is located vertically lower than said first and second platforms.

4. The taboret of claim 3 wherein said fourth platform is located directly below and concentric with said first platform and is supported by interconnection to the leg members of each leg of said first set of three legs.

5. The taboret of claim 2 including a horizontal fifth platform located vertically lower than said second platform and supported by interconnection to the leg members of at least one leg of said second set of two legs.

6. The taboret of claim 5 wherein said fifth platform is located directly below and concentric with said second platform and is supported about the periphery thereof by one of said first set of legs by interconnection with the leg members thereof and interconnection with the leg members of said second set of two legs.

7. The taboret of claim 1 wherein said first, second and third sets of legs have upper terminal end portions which extend above said platforms and terminate in a dome-shaped structure.

8. The taboret of claim 7 wherein said first, second and third sets of legs include lower terminal extensions which terminate in a dome-shaped structure.

* * * * *